United States Patent [19]

Jaicks

[11] Patent Number: 4,666,054

[45] **Date of Patent: * May 19, 1987**

[54] ANIMAL PROOF STORAGE CONTAINER APPARATUS

[75] Inventor: John R. Jaicks, 945 Morris Park Ave., Bronx, N.Y. 10462

[73] Assignee: John R. Jaicks, Bronx, N.Y.

[ * ] Notice: The portion of the term of this patent subsequent to Dec. 17, 2002 has been disclaimed.

[21] Appl. No.: 775,747

[22] Filed: Sep. 13, 1985

Related U.S. Application Data

[63] Continuation-in-part of Ser. No. 535,655, Sep. 26, 1983, Pat. No. 4,558,796.

[51] Int. Cl.[4] ..... B65F 1/16; B65D 25/28; B65D 41/04

[52] U.S. Cl. ..... 220/1 T; 220/94 R; 220/288

[58] Field of Search ..... 220/1 T, 94 R, 288

[56] References Cited

U.S. PATENT DOCUMENTS

| | | | |
|---|---|---|---|
| 76,229 | 3/1968 | Miller | 220/288 |
| 674,530 | 5/1901 | Wilcox | 220/288 |
| 918,265 | 4/1909 | Bender | 220/94 R |
| 1,037,625 | 9/1912 | Hofer | 220/1 T |
| 1,286,368 | 12/1918 | Lucas | 220/20.5 |
| 1,683,823 | 9/1928 | Heil | 220/288 |
| 1,961,298 | 6/1934 | Lundy | 220/288 |
| 3,094,218 | 9/1975 | Kostic | 220/1 T |
| 4,351,539 | 9/1982 | Rodolakis | 220/1 T |
| 4,363,417 | 12/1982 | Rhoades | 220/1 T |

FOREIGN PATENT DOCUMENTS

| | | | |
|---|---|---|---|
| 19832 | 12/1980 | European Pat. Off. | 220/1 T |
| 1500504 | 7/1975 | United Kingdom | 220/1 T |

*Primary Examiner*—George E. Lowrance

*Attorney, Agent, or Firm*—Lackenbach Siegel Marzullo & Aronson

[57] ABSTRACT

A storage container forming a compartment for storing garbage or edibles. The compartment is kept sealed from entry by a wild animal by a circular lid member being threadable onto the container member. A plurality of vertically extending hand grips are connected to the lid member at angular intervals. A plurality of peripheral recesses are formed at angular intervals around the rim of the bottom wall of the container that are adapted to receive the forward part of the foot of a user so the user can hold the container member against the support surface with one or both feet while threading the lid onto or from the container member. The generally cylindrical wall of the container is tapered inwardly top to bottom so that a number of containers can be stacked one inside another. Side lifting handles are provided.

6 Claims, 7 Drawing Figures

ANIMAL PROOF STORAGE CONTAINER APPARATUS

BACKGROUND OF THE INVENTION

This application is a continuation-in-part of an application entitled "Animal Proof Storage Container", Ser. No. 535,655, filed Sept. 26, 1983 now U.S. Pat. No. 4,558,796.

This invention relates generally to protecting the contents of a storage container such as a garbage container from relatively large wild or domestic animals. The type of storage container generally contemplated here is that of what is commonly known as a garbage can and is approximately 2 to 2½ feet in diameter and approximately 2½ to 3 feet in height. The storage capacity is approximately 25–35 gallons for a conventional garbage can.

It is known that animals, more commonly wild animals, such as raccoons, bears, coyotes, and the like in search of food, are ingenious and cunning at gaining access to storage containers that hold edibles. One common case in point is the raccoon of suburban communities throughout the United States that are adept at removing the lids of garbage containers at night and pulling out and strewing around the contents of the container. In the morning, the people living in the house find the garbage that was neatly packed away the night before thrown about the area of the container. These occurrences are repeated by other animals, such as bears and coyotes, that tend to enter more remote human habitational areas in certain parts of the country at night in search of food.

Yet there seems to be no available system of preventing these animals from entering the containers, except for systems that most people would not want to bother with. In general, people simply want to place the family garbage in a container with traditional lids, rather than resort to a complex prevention system. It is to be noted that garbage containers especially are usually set out for pick up and then are brought back to a garbage storage site subsequent to pick up, a process that calls for garbage containers not burdened with a complex locking system.

Some of the systems presently employed for preventing animals from getting into garbage containers involve the use of tie down straps and hooks or springs. The device employing springs requires their providing tension when in use so as to tightly keep the cover or lid on the container. As a result thereof, the springs, when in use, can easily hurt people as sometimes they can be inadvertently disconnected and could fly off or snap and easily whip lash around and cause injury to either the homeowner or a sanitation man. In fact, most sanitation men do not like such tie down devices because they physically maintain the lid attached to the container. In so doing, the lid is an obstruction and makes it difficult for the pail to be emptied.

Moreover, these tie down devices and other spring gadgets are expensive and must be frequently replaced, as they are easily broken, particularly by the sanitation men who usually handle the covers and lids in a rough manner, and prefer not to have the lid or cover physically restrained in place to the container itself. With the storage container of the present invention, the sanitation men would have no difficulty in emptying the container as the lid is completely removed and is not restrained and held against the container when the lid is unthreaded.

Prior application Ser. No. 535,655 provided a viable animal proof storage container. One improvement to that invention relates to the adaptability of the container to be stacked during shipment and storage. The outwardly extending flange prevented such stacking. Also, the wall of the container was not tapered. Also, as a general matter, handles for picking up the container were not set forth.

Easily operated systems for preventing animals from entering storage container are not generally available for containers other than garbage containers. Often food at a campsite, for example, cannot be left in a simple container with a lid, for a large animal can easily remove the lid and rummage through the container.

Patents applied against application Ser. No. 535,655 are as follows:

(1) "Sanitary Receptacle", U.S. Pat. No. 1,037,625, issued to L. Hofer, Sept. 3, 1912;

(2) "Liquefier Screw Cover", U.S. Pat. No. 1,961,298 issued to T. F. Lundy, June 5, 1934; and (3) "Paint Can", U.S. Pat. No. 76,229 issued to D. Miller, Mar. 31, 1868.

Other patents cited by the Examiner during the prosecution of the prior application are as follows:

| Inventor | Patent | Issue Date |
|---|---|---|
| Wilcox | U.S. 674,530 | May 21, 1901 |
| Lucas | U.S. 1,286,368 | Dec. 3, 1918 |
| Heil | U.S. 1,683,823 | Sept. 11, 1928 |
| Zinkel | European 19,832 | Dec. 10, 1980 |
| Moore | Great Britain 1,500,501 | Feb. 10, 1978 |

A number of other patents have been issued by the U.S. Patent Office and foreign patent offices that relate generally to refuse containers having handles attached or having elongated members acting between the face of the closure and opposed abutments of the walls of the container.

Such art includes U.S. Pat. No. 550,183 issued Nov. 19, 1895 to J. Leembruggen that discloses a receptacle for food having a pair of slanted outwardly curved grooves 5,5* formed in the circular wall of the receptacle. Grooves 5,5* are adapted to receive the ends of a hold down device comprising a spring 6, the middle portion of which is bent to a concave form and is arranged to press upon the top of cover 3 and to force the rim 4 thereof toward the shoulder 2. The spring lock is not particularly advantageous as a discouragement to wild animals, who would most likely worry away the spring from the grooves.

Another patent is U.S. Pat. No. 2,279,991 issued Apr. 14, 1942 to J. K. Hotchkiss that discloses a jar closure having slots formed by strands 12 into which are snugly received the lugs 8 of the jar A upon a requisite turning movement of the member R. This invention again, if applied to a garbage container, would unlikely to prove an obstacle for very long against the patient efforts of animals to enter the container.

Still another invention is U.S. Pat. No. 552,948 issued Jan. 14, 1896 to M. Witt that discloses a vessel and cover for removal of refuse. A centerplate i of the cover is pressed downardly by screw 1, with the centerplate in turn is pressed upon the receptacle around a tightening-ring that bears upon a bead b around the periphery of the receptacle. The tightening-ring in turn is held between a pair of cover places h and g, with centerplate bearing upon plate h. The described invention is comparatively elaborate and although effective for providing a seal around the mating circumference of the cover and receptacle, it is over-elaborate as far as providing a barrier to wild animals. It may also be noted that upper plate h of the cover is bulged and resiliently yields upon tightening of the top screw. Here a metal material is required with several parts with the resulting weight factor, not to mention the cost. Lightweight plastic also is an unlikely material for this invention.

Other patents of interest in this case are as follows:

| Inventor | U.S. Pat. No. | Issue Date |
|---|---|---|
| Gluckman | 926,864 | July 6, 1909 |
| Nylund | 1,129,222 | February 23, 1915 |
| Porter | 1,728,945 | September 24, 1928 |
| Hight | 1,802,551 | April 28, 1931 |
| Loeber | 1,856,877 | May 3, 1932 |
| Wenger | 1,892,743 | January 3, 1933 |
| Curtis | 2,111,359 | March 15, 1938 |
| Urech | 2,123,126 | July 5, 1938 |
| Tiffany | 2,238,379 | April 15, 1941 |
| Biddlecombe | 2,632,580 | March 24, 1953 |
| Worth | 2,717,167 | September 6, 1955 |
| Freser | 2,756,084 | July 24, 1956 |
| Zobel | 4,351,449 | September 28, 1982 |
| McQuiston et al. | 4,384,656 | May 24, 1982 |

SUMMARY OF THE INVENTION

Accordingly, it is an object of the present invention to provide a storage container that is simple to manufacture, easy to operate, and very effective against being entered by animals, and even other pests, such as insects, roaches, etc., as the full threaded means of the storage container precludes odors from escaping and also is an extremely tight connection which cannot be penetrated.

It is another object of the present invention to provide a storage container that is fool proof and cannot be opened by an animal.

It is yet another object of this invention to provide an animal proof storage container having a lid that can be manipulated by vertically extending handles so as to be threaded onto or from the container.

It is yet another object of this invention to provide an animal proof storage container provided with a threaded lid with vertical handles and a threaded container provided with foot flanges for holding down the container as the lid is being screwed onto or from the container.

It is yet another object of the present invention to provide an animal proof storage container having foot recesses at the base of the container so that the user can hold down the container as the lid is being screwed onto or from the container.

It is yet another object of the present invention to provide animal proof storage containers that can be stacked one atop the other for storage or shipment.

It is yet a further object of the present invention to provide an animal proof storage container that can be lifted by handles.

Accordingly, in order to achieve the above objects, as well as others that will become apparent hereafter, an animal proof storage container apparatus is provided including a substantially rigid generally cylindrical container member having a circular bottom wall resting upon a support surface and having an upright generally circular side wall thus defining a substantially enclosed storage compartment. The side wall has a circular top rim portion and externally disposed thread means at an upper edge of the top rim portion. A substantially rigid lid member has a circular top all and a downwardly directed flange. The lid member has internally disposed thread means on the downwardly directed flange. The lid member thread means and the container member thread means comprise substantially one complete revolution and are for removably connecting the lid member and the container member in threaded relationship. Gripping means include a plurality of handles extending upwardly from the lid member and are generally peripherally disposed adjacent to the flange of the lid member, wherein the handles are circumferentially spaced for providing hand holds for a user in the process of threading or unthreading the lid member onto or from the top rim portion of the container member. The support surface frictionally cooperates with the container member in association with the bottom wall to provide resistance to turning during the threading and unthreading process. Hold down means extend into the compartment from the side wall positioned at the bottom wall, enabling a user to press at least one foot in the hold down means against the bottom wall so as to hold the container member stationary against the support surface while the lid member is being screwed onto or from the container member, whereby a complete and maximum securing of the lid member to said container member is achieved. The hold down means includes an aperture formed by the side wall at the bottom wall. The aperture has opposed generally vertical side rims and a generally horizontal top rim. The bottom wall forms the bottom rim; and a pair of opposed, generally parallel triangulated side walls having downwardly angled top edges extend into the compartment from the side rims. A downwardly angled top wall extends from the top rim into the compartment and is joined to the top walls at the top edges. The side walls, the top wall, and the bottom wall of the container define a recess adapted to receive the foot of a user in downwardly pressing relationship. The side wall of the container member is tapered inwardly betWeen the external thread means and the bottom wall, whereby a plurality of the container members can be stacked in a nestled relationship. The external thread means of the container member extends generally vertically to the top of the tapered side wall. Handle means are attached to the side wall for a user to hold when lifting the storage container. The handle means include the side wall of the container member forming a pair of opposed handle recesses opening to the outer surface of the container member; and a pair of handles connected to the container side wall and positioned in the pair of recesses. The pair of handles ard movable between generally vertical non-use positions in the pair of recesses and generally upward use positions extending beyond the surface of the side wall, whereby the handles can be held by a user.

The present invention will be better understood, and the objects and important features, other than those specifically enumerated above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof. Other embodiments or modifications may be suggested to those having the benefit of the teachings herein, and such other embodiments or modifications are intended to be reserved especially as they fall within the scope and spirit of the subjoined claims.

DESCRIPTION OF THE PREFERRED EMBODIMENTS

Figure 4:
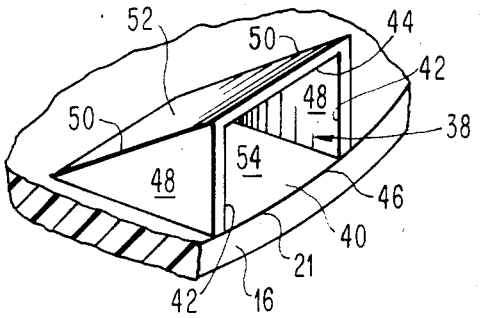
FIG. 4 is a perspective view of a typical foot hold-down device with the side wall of the container member removed.

Reference is now made specifically to the drawings, in which identical or similar parts are designated by the same reference numerals throughout.

Figure 1:
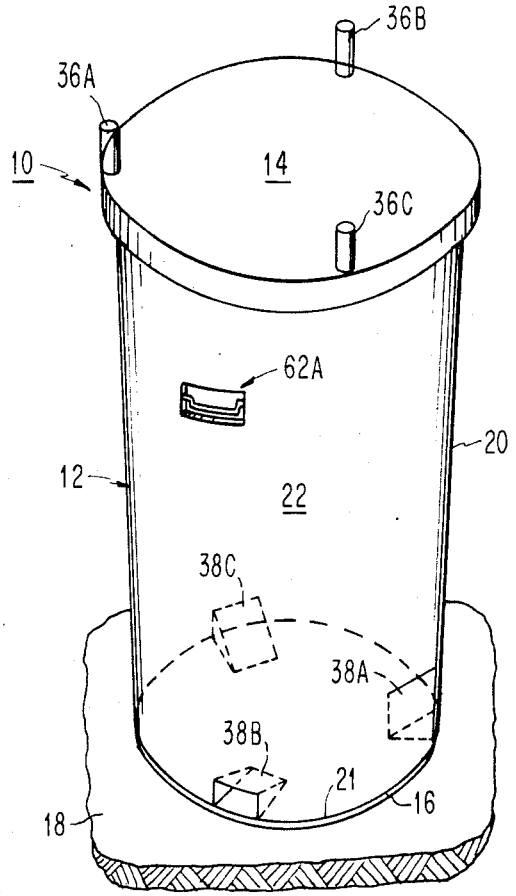
FIG. 1 is a perspective view of the invention with the lid member secured to the container member.
Figure 3:
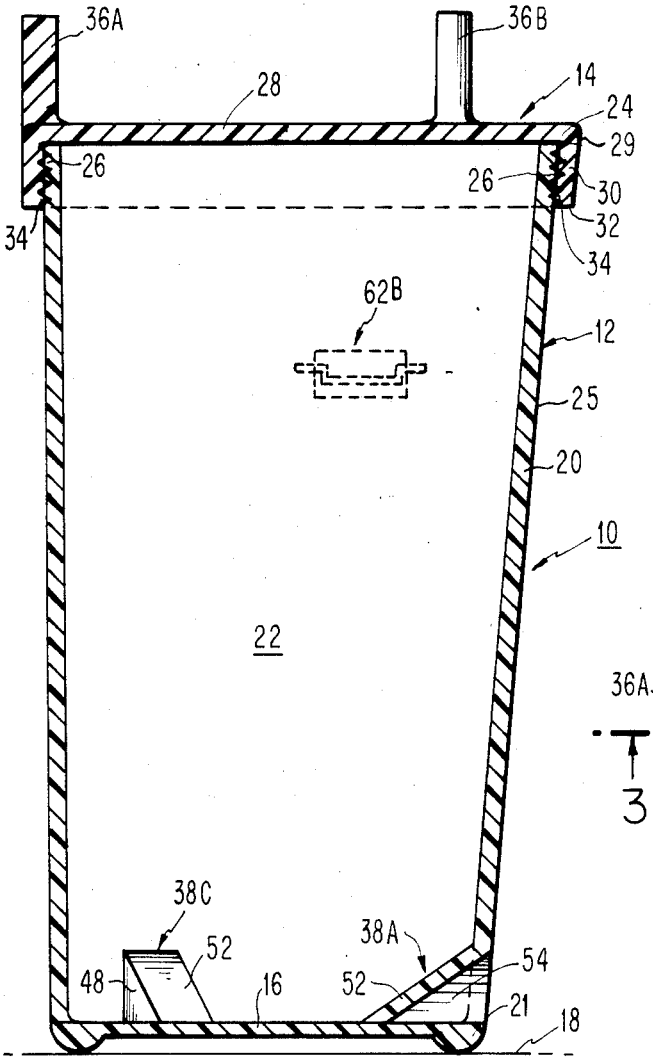
FIG. 3 is a sectional view taken through line 3—3 of FIG. 2.
Figure 2:
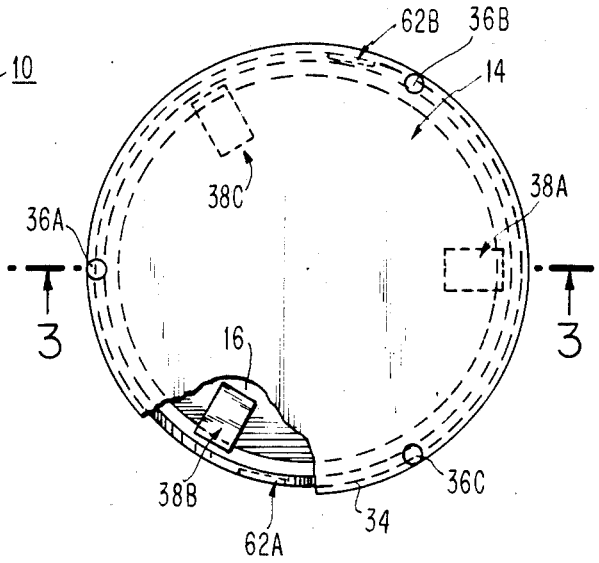
FIG. 2 is a top view of the invention.

FIG. 1 illustrates in perspective view a storage container system 10 including a substantially rigid, generally cylindrical container member 12 and a substantially rigid, generally cylindrical lid member 14. Storage container 10 is of the general size of what is commonly known as a garbage can and is approximately 2 to 2½ feet in diameter and approximately 2½ to 3 feet in height. System 10 is made of a plastic material. As shown in FIGS. 2 and 3, container member 12 has a substantially horizontal circular bottom wall 16 that rests upon a flat support surface 18 such as a floor or the ground. Container member 12 also includes an upright, or substantially vertical, side wall 20 that is secured at its bottom rim portion 21 to bottom wall 16. Bottom wall 16 and side wall 20 define a generally cylindrical compartment 22 for containing edible substances such as garbage that would be an attraction for wild animals. Compartment 22 has an approximate capacity of 25–35 gallons. Compartment 22 has a substantially horizontal open face defined by the circular top rim portion 24 of circular side wall 20. The outer surface 25 of side wall 20 forms an external Thread portion 26 that extends downwardly from top rim portion 24. thread portion 26 will be discussed further below.

As also shown in FIGS. 1, 2 and 3, lid member 14 has a circular top wall 28 and a short circular edge wall 30 formed in a piece with the circular edge portion 29 of top wall 28. Circular edge wall 30 has a circular bottom rim portion 32. Edge wall 30 depends vertically from circular edge portion 29 of top wall 28. The inner surface of edge wall 30 forms an internal thread portion 34 between top edge portion 29 and bottom rim portion 32 that is adapted to mate with external thread portion 26 of container member 12. FIG. 3 indicates three fully circumferential, mating threads of external and internal thread portions 26 and 34. It is noted that at least one full set of mating threads should be formed, and alternatively two, three or more full mating threads be formed. When internal thread portion 34 of lid member 14 has been threaded onto external thread portion 26 of container member 12, edge wall 30 of lid member 14 fits closely around side wall 26, lid member 14 and container member 12 have been disengageably connected, and compartment 22 has been made secure against entry by animals.

As also can be seen in FIGS. 1, 2 and 3, three hand grips 36A, 36B and 36C extend upwardly from top wall 28 of lid member 14 at circular edge portion 29 directly above edge wall 30. Hand grips 36A, 36B and 36C are integral with lid member 14. Each hand grip 36A, 36B and 36C is an elongated cylindrical handle of the same plastic material as lid member 14 that extends substantially vertically to a distance that allows a good hand grip for a user. The diameter of each hand grip 36A, 36B, and 36C likewise is such that it gives a user a good hand grip. Hand grips 36A, 36B and 36C are circumferentially spaced at substantially equal angular intervals around edge portion 29. In particular as shown in FIG. 2, the angular intervals are approximately 120°. This angular spacing allows a user to utilize both hands to screw or unscrew lid member 14 onto or from container member 12 without stretching.

As can be seen in FIGS. 1, 2 and 3, and in detail in FIG. 4 three hold-down devices 38A, 38B and 38C extend into compartment 22 from side wall 20 positioned at bottom wall 16 so that a user is enabled to press the forward part of at least one foot in one of the hold-down devices 38A, 38B and 38C against bottom wall 16 and thus hold container member 12 against ground 18 so as to keep container member 12 stationary while lid member 14 is being screwed onto or from container member 12 so that a complete and maximum screwing of lid member 14 to container member 12 is achieved.

Each hold-down device 38A, 38B and 38C as illustrated in the typical representation as hold-down device 38 includes a generally rectangular aperture 40 formed by side wall 20 at bottom wall 16. aperture 40 has opposed, generally vertical side rims 42 and a generally horizontal top rim 44. Bottom wall 16 forms the generally horizontal bottom rim 46. A pair of opposed, generally parallel, triangular, side walls 48 having downwardly angled top edges 50 generally radially extend into compartment 22 from side wall 20 at bottom rim portion 21. A downwardly angled top wall 52 extends from top rim 44 into container 22 and is joined to side walls 48 at top edges 50. Side walls 48, top wall 52 and bottom wall 16 form a recess 54 adapted to receive the forward part of the shoe or foot of a user in downwardly pressing relationship.

Hold-down device 38 as described above can of course be configured somewhat differently than the triangular recess 54. For example, the recess can be rectangular with the side walls likewise being rectangular.

Figure 5:
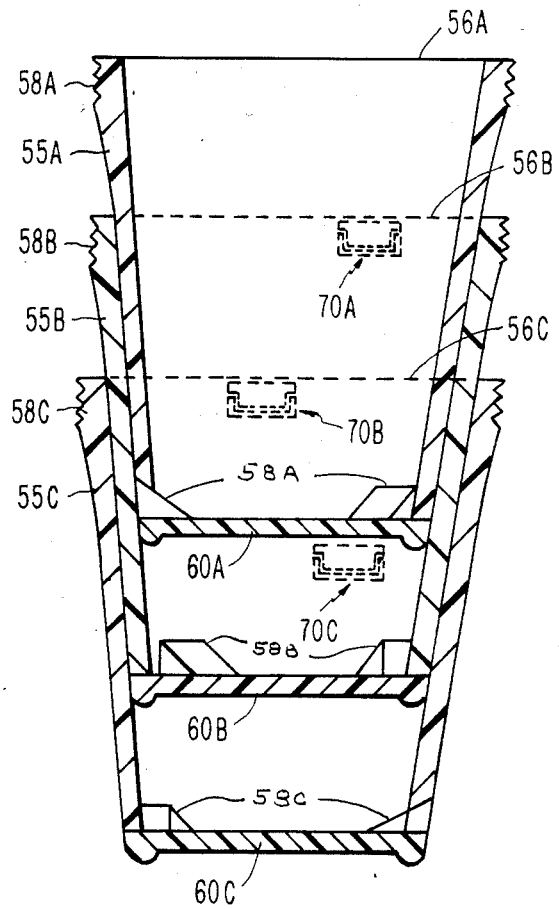
FIG. 5 is a sectional elevational view of the stacked container members.

The side walls 55A, 55B and 55C of three container members 56A, 56B and 56C are tapered top to bottom so that the container members can be nestled as shown in FIG. 5. The angular orientations of the container members vary so that their respective holddown devices 58A, 58B, and 58C are shown in erratic relative positions. The inner and outer diameters of the container members are so tapered that successive containers can be nestled inside the other. As shown in FIG. 5A, the external rim portions 58A, 58B and 58C of the container members top to bottom, respectively, are preferably vertical and not tapered. Hold-down devices 58A, 58B and 58C space the container members from fully nestled position at their respective bottom walls 60A, 60B and 60C. The angle of the taper of side walls 55A, 55B and 55C can be varied so as to increase or decrease the depth of their nestle, that is, the distance between their bottom walls 58A, 58B and 58C. The adaptability to nestling allows compression of storage and shipping space needed for a plurality of container members 12.

Figure 7:
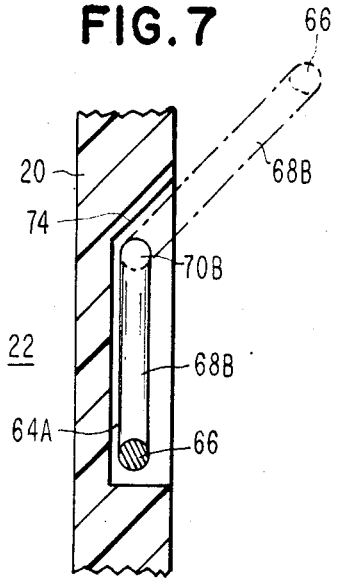
FIG. 7 is a sectional view of the handle taken through line 4—4 of FIG. 4.
Figure 6:
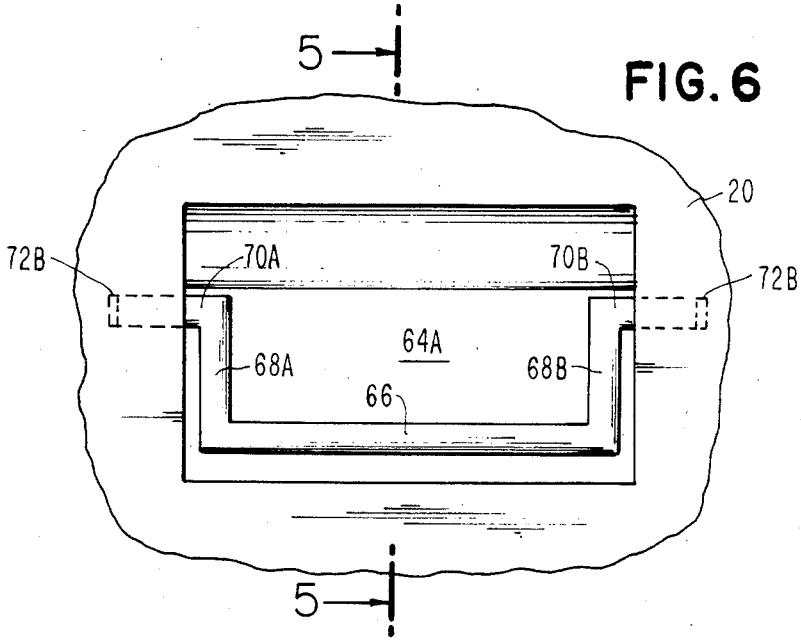
FIG. 6 is an isolated front view of a handle.

As shown in FIGS. 1, 2, 3, 5 and in detail in FIGS. 6 and 7, a pair of oppositely positioned handles 62A and 62B are set into handle recesses 64A and 64B formed preferably between the mid-height of container member 12 and top rim portion 24. Representative handle 62A, shown in FIGS. 6 and 7, includes a horizonal cross-bar 66 adapted to be gripped by the hand of a user, a air of opposed vertical swing bars 68A and 68B connected at their bottom ends to the ends of cross-bar 66, and a pair of pivot bars 70A and 70B that extend outwardly from the top ends of and extend into horizontal pivot recesses 72A and 72B formed by side wall 20 at the top of handle recess 64A. Handle 62A is rotatable between a vertical position seen in FIG. 6 and in solid line in FIG. 7, and an upwardly angled orientation in phantom line in FIG. 7 with handle 66 and swing bar 68B indicated. Side wall 20 forms handle recess 64A with an upwardly angled top wall 74 that allows handle 62A to be moved past a horizontal to a generally upward position that allows a user to more efficiently exert a full upward pull and to reduce stress against swing bars 68A and 68B by the top edge of pivot recess 72A.

Handles 62A and 62B are indicated in the nestled configuration in FIG. 5 as handles 70A, 70B and 70C for container members 56A, 56B and 56C, respectively.

The embodiments shown and described set forth an internal lid member, internal thread adapted to be threaded onto a container member external thread. Within the spirit and scope of the invention, however, the container member can form an internal thread portion in the inner surface of the container member and an external thread portion be formed on the side wall of the lid member, so that the lid member may be set within the inner surface of the container member and screwed onto the internal threads of the container member.

It should also be appreciated that with the present invention, an extremely tight connection is achieved between the threaded means of the lid and container. As a result thereof, insects, bugs and other pests are precluded from being attracted to the container. Also, as any malodorous odors can also be kept sealed in the container, the garbage pail or storage container can be kept indoors, such as in a garage, until it is time for collection. In this regard, as daily sanitation collection no longer exists and as municipalities are constantly cutting down services to two or three collections a week, the present apparatus is very desirable as it provides a tight seal almost equivalent to that type of a seal provided by a conventional Mason jar. Furthermore, a homeowner need only have one container of the invention and could cull his refuse so that all perishable materials can be disposed of in the storage container of the present invention, hile other more conventional garbage cans could be used for other non-perishable refuse, such as newspapers, wrappings, empty bottles and cartons, etc.

If desired, a lift and a carrying handle such as described and shown in my parent application may be employed in the practice of the present invention.

The embodiment of this invention particularly disclosed and described hereinabove is presented merely as an example of the invention. Other embodiments, forms and modifications of the invention coming within the proper scope and spirit of the appended claims will, of course, readily suggest themselves to those skilled in the art.

What is claimed is:

1. An animal proof storage container system, comprising, in combination:

a substantially rigid generally cylindrical container member having a circular bottom wall resting upon a support surface and having an upright generally circular side wall thus defining a substantially enclosed storage compartment, said side wall having a circular top rim portion and externally disposed thread means at the upper edge of said top rim portion, a substantially rigid lid member having a circular top wall and having a downwardly directed flange, said lid member having internally disposed thread means on said downwardly directed flange, said lid member thread means and said container member thread means comprising substantially one complete revolution and being for removably connecting said lid member and said container member in threaded relationship, gripping means including a plurality of handles extending upwardly from said lid member and being generally peripherally disposed adjacent said flange of said lid member, wherein said handles are circumferentially spaced for providing hand holds for a user in the process of threading or unthreading said lid member onto or from said top rim portion of said container member, said support surface frictionally cooperating with said container member in association with said bottom wall to provide resistance to turning during the threading and unthreading process, and hold-down means extending into said compartment from said side wall positioned at said bottom wall, enabling a user to press at least one foot in said hold down means against said bottom wall so as to hold said container member stationary against said support surface while said lid member is being screwed onto or from said container member, whereby a complete and maximum securing of said lid member to said container member is achieved.

2. The storage container according to claim 1, wherein said hold down means includes an aperture formed by said side wall at said bottom wall, said aperture having opposed generally vertical side rims and a generally horizontal top rim, said bottom wall forming said bottom rim; and a pair of opposed, generally parallel triangulated side walls having downwardly angled top edges extending into said compartment from said rims and a downwardly angled top wall extending from said top rim into said compartment joined to said top walls at said top edges, said side walls, said top wall, and said bottom wall of said container defining a recess adapted to receive the foot of a user in downwardly pressing relationship.

3. The storage container according to claim 2, wherein said side wall of said container member is tapered inwardly between said external thread means and said bottom wall, whereby a plurality of said container members can be stacked in a nestled relationshp.

4. The storage container according to claim 3, wherein said external thread means of said container member extend generally vertically to the top of said tapered side wall.

5. The storage container according to claim 5, wherein said handle means includes said side wall of said container member forming a pair of opposed handle recesses opening into the outer surface of said container member; and a pair of handles connected to said container side wall and positioned in said pair of recesses, said pair of handles being movable between generally vertical nonuse positions in said pair of recesses and generally upward use positions extending beyond said surface of said side wall, whereby said handles can be held by a user.

6. The storage container according to claim 4, further including handle means attached to said side wall for a user to hold when lifting said storage container.

* * * * *